US005430963A

United States Patent [19]

Kuo-Chu

[11] Patent Number: 5,430,963

[45] Date of Patent: Jul. 11, 1995

[54] IRON INCLUDING PRESSURIZING AND EMITTING STEAM CHAMBERS AND REMOTE RESERVOIR

[76] Inventor: Chien Kuo-Chu, No. 202-1, Shen Chou Rd., Shen Kang Hsiang, Taichung Hsien, Taiwan

[21] Appl. No.: 157,975

[22] Filed: Nov. 23, 1993

[51] Int. Cl.[6] ..... D06F 75/12; D06F 75/24

[52] U.S. Cl. ..... 38/77.6; 38/77.83

[58] Field of Search ..... 38/77.4, 77.5, 77.6, 38/74, 77.83, 77.9, 95, 81; 219/245, 247, 254, 259

[56] References Cited

U.S. PATENT DOCUMENTS

| | | | |
|---|---|---|---|
| 437,758 | 10/1890 | Hand | 38/95 X |
| 2,073,657 | 3/1937 | Stockton | 38/77.6 |
| 2,247,438 | 7/1941 | Gorton | 38/77.6 X |
| 2,637,126 | 5/1953 | Fitzsimons | 38/77.9 X |
| 2,851,050 | 9/1958 | Cissell et al. | 38/77.6 X |
| 2,871,587 | 2/1959 | Jepson | 38/77.6 |
| 3,238,649 | 3/1966 | Denton | 38/81 X |
| 3,508,354 | 4/1970 | Stansbury et al. | 38/77.6 |
| 3,869,815 | 3/1975 | Bullock | 38/77.6 |
| 3,872,613 | 3/1975 | Davidson et al. | 38/77.83 |
| 3,930,325 | 1/1976 | Schaeffer et al. | 38/77.9 |
| 5,010,664 | 4/1991 | Sakano et al. | 38/74 X |

*Primary Examiner*—Clifford D. Crowder
*Assistant Examiner*—Ismael Izaguirre
*Attorney, Agent, or Firm*—W. Wayne Liauh

[57] ABSTRACT

A steam iron is provided with a vaporization chamber, an electric heater, a steam emitting chamber and a soleplate, which are made integrally. The vaporization chamber is provided therein with a pressure accumulating container for stabilizing and rectifying the pressure of steam before the steam is emitted onto the material or garment being pressed. The vaporization chamber and the steam emitting chamber are provided respectively with a detachable cover so that the vaporization chamber and the steam emitting chamber can be cleaned and washed easily for removing the impurities clogging the steam emitting holes.

3 Claims, 5 Drawing Sheets

IRON INCLUDING PRESSURIZING AND EMITTING STEAM CHAMBERS AND REMOTE RESERVOIR

BACKGROUND OF THE INVENTION

The present invention relates generally to an electrical household appliance, and more particularly to a steam iron.

A steam iron forms steam from water and releases it through the soleplate onto the material or garment being pressed. Such steam iron is used commonly in the private homes, the commercial laundries, or the factories. However, such conventional steam iron as described above has several shortcomings, which are described hereinafter.

The heater and the vaporization chamber of the steam iron are made integrally and are fastened by screws to the soleplate of the steam iron. The heat generated by the heater of the steam iron is not directly transmitted to the soleplate. As a result, the steam reaching the steam emitting holes of the soleplate is not reheated, thereby resulting in an unsatisfactory ironing result.

The conventional steam iron has a vaporization chamber in which the steam is formed of water. The steam so formed is then sent to the steam emitting holes of the soleplate via the guide tube. Such a structural design as described above is defective in that the steam is susceptible to condensation by the time when the steam has reached the steam emitting holes of the soleplate. Therefore, the steam is not emitted evenly and forcefully onto the material or garment bring pressed.

The conventional steam iron is generally devoid of a steam pressurizer and is therefore incapable of emitting the steam in a continuous and forceful manner to ensure a satisfactory ironing result.

The conventional steam iron is provided with the steam ducts which serve to transport the steam from the soleplate to the steam emitting holes. Such steam ducts are vulnerable to being clogged by dirt contained in the steam. It is difficult to remove the dirt clogging the steam duct. As a result, the service life span of the steam iron is inevitably shortened.

SUMMARY OF THE INVENTION

It is, therefore, the primary objective of the present invention to provide an improved steam iron, which overcomes the shortcomings of the prior art steam iron described above.

A further objective of the present invention is to provide an improved steam iron comprising a soleplate, a heater, a vaporization chamber, a pressure accumulation chamber and a steam emitting chamber, which are made integrally by casting. The introduction of water into the vaporization chamber from the water reservoir is regulated by an electromagnetic valve. As soon as water is introduced into the vaporization chamber, the steam is formed by the heater located between the vaporization chamber and the soleplate. The flow of steam is stabilized by means of the pressure accumulation chamber disposed in the vaporization chamber. The steam is then allowed to enter the steam emitting chamber via a duct disposed at the bottom of the pressure accumulation chamber. As steam enters the steam emitting chamber, the steam is not susceptible to condensation in view of the fact that the steam emitting chamber, the vaporization chamber and the soleplate are made integrally. The steam emitting chamber is provided with a rough periphery in which a greater number of steam emitting holes can be disposed for enhancing the steam emitting effect. The process of heating the soleplate is regulated by a control device such that the overheating of the soleplate does not take place. The control device includes a circuit breaker, which interrupts automatically the flow of an electric current at the time when the overheating of the soleplate occurs. In addition, the steam is so pressurized in the pressure accumulation chamber that the steam is emitted forcefully onto the material or garment being pressed.

A still further objective of the present invention is to provide an improved steam iron with detachable covers of the vaporization chamber and the steam emitting chamber. As a result, the foreign objects accumulated in the vaporization chamber and the steam emitting chamber can be easily removed therefrom, thereby preventing the steam emitting holes from being clogged.

DETAILED DESCRIPTION OF THE INVENTION

Figure 1:
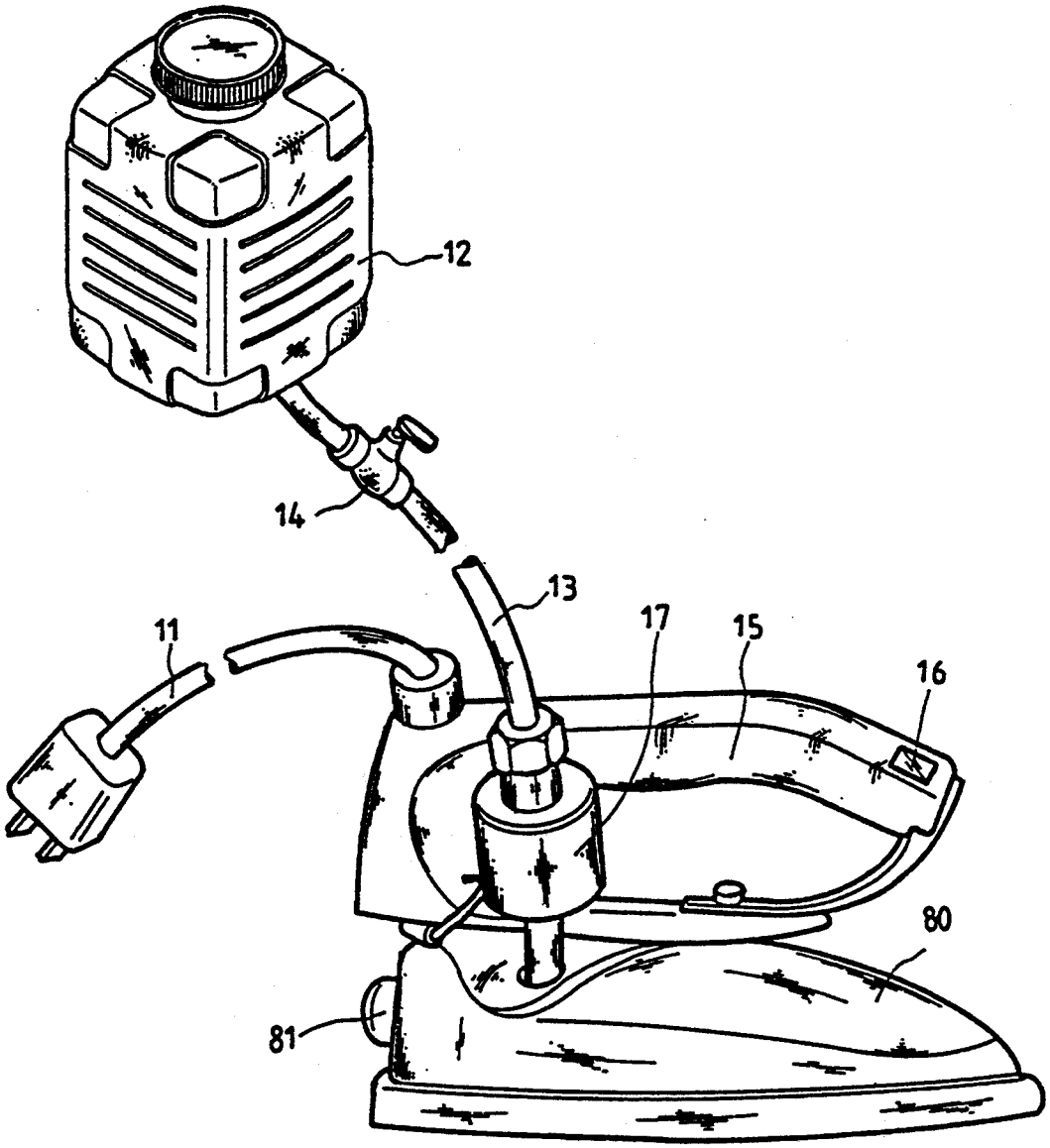
FIG. 1 shows a perspective view of the present invention.
Figure 2:
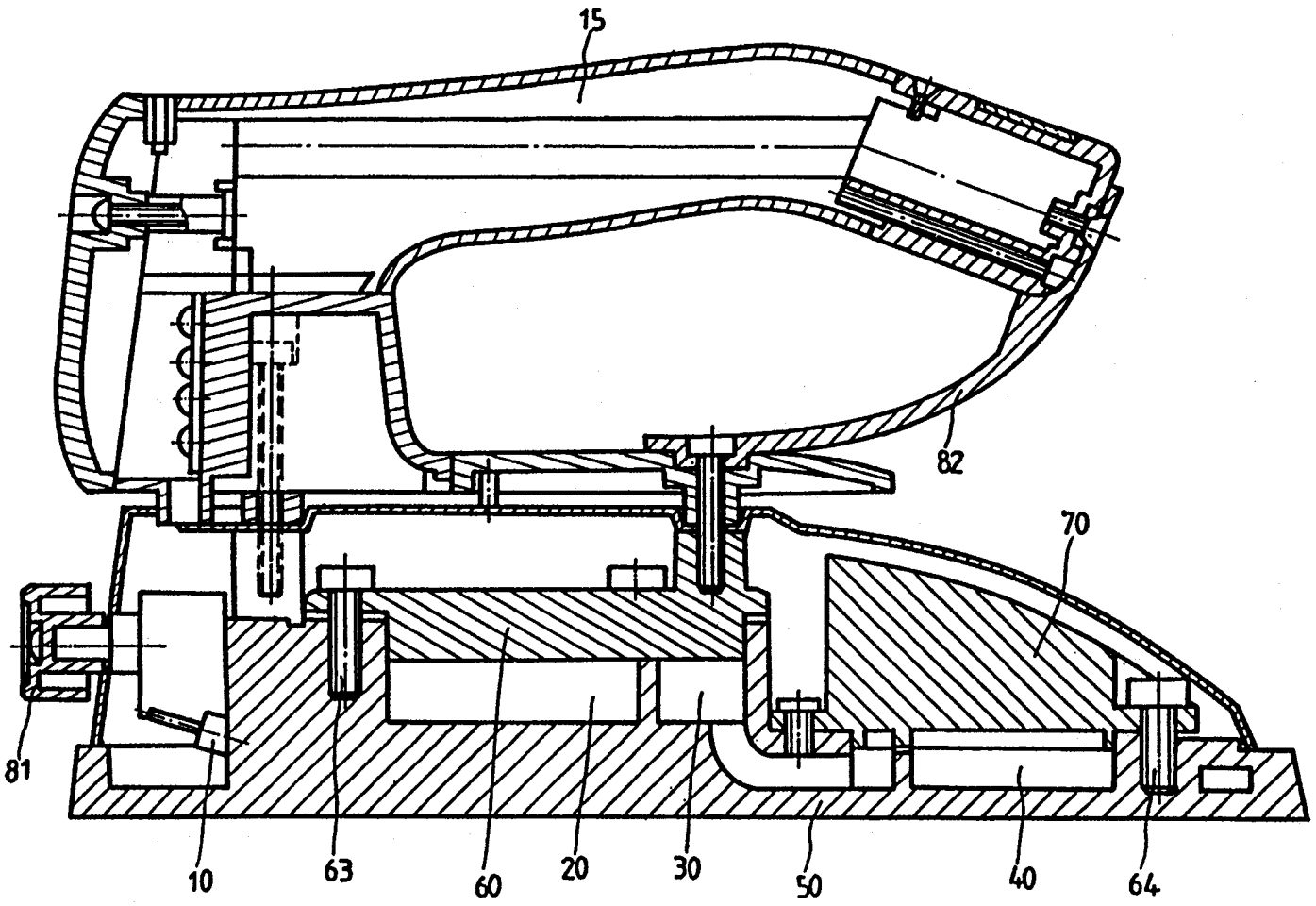
FIG. 2 shows a sectional view of the present invention.
Figure 3:
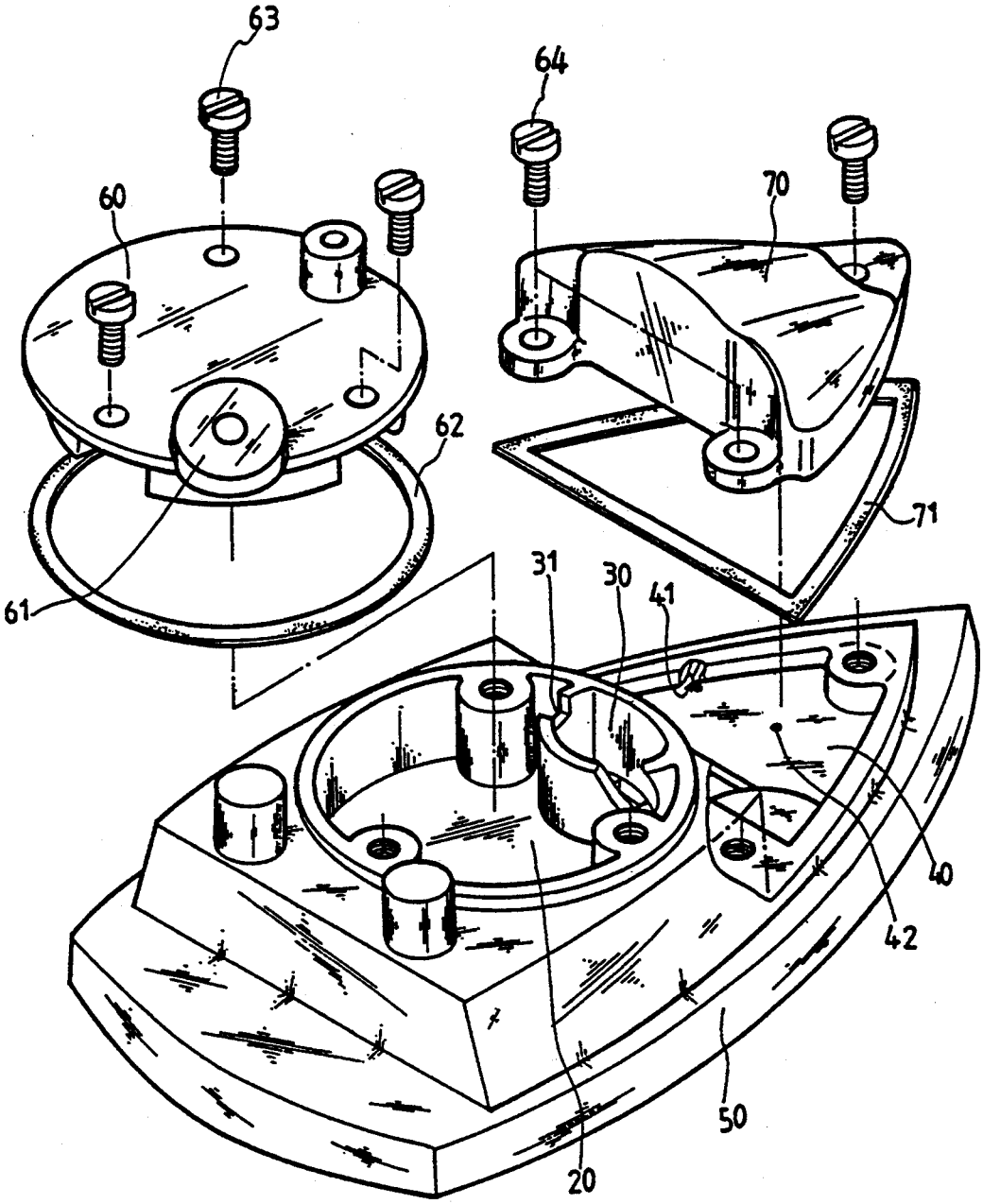
FIG. 3 shows an exploded view of a vaporization device of the present invention.
Figure 4A:
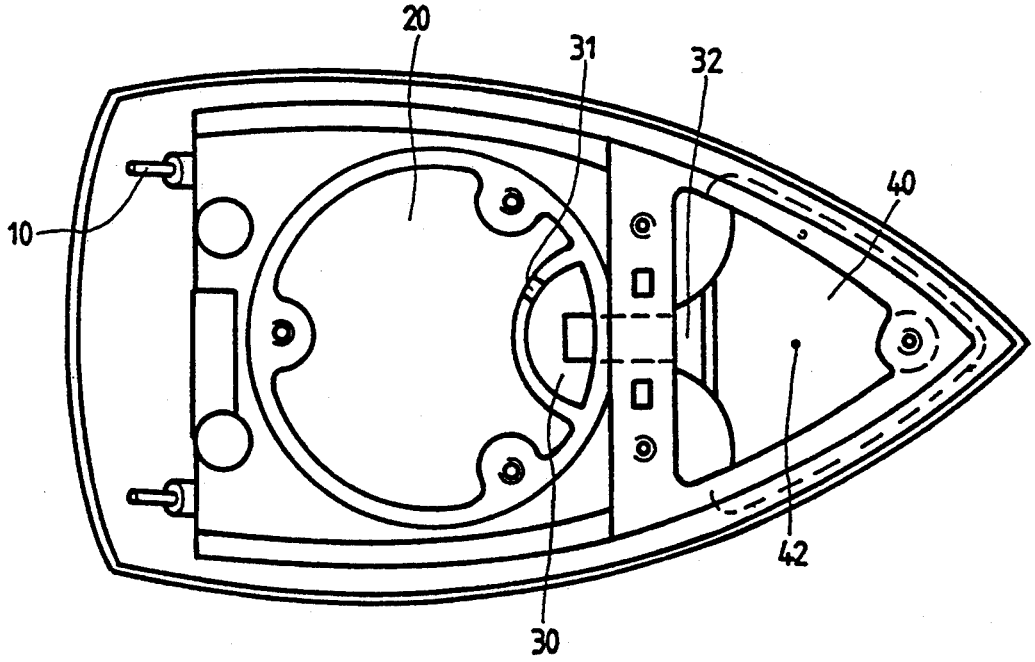
FIG. 4 shows a plan view of the vaporization device of the present invention.
Figure 4B:
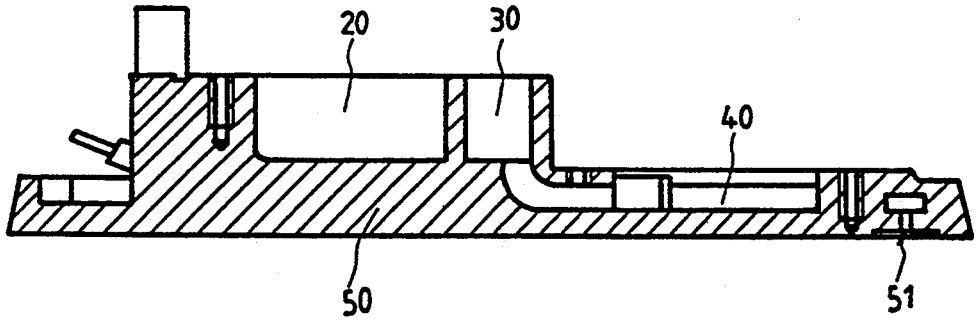
Figure 5:
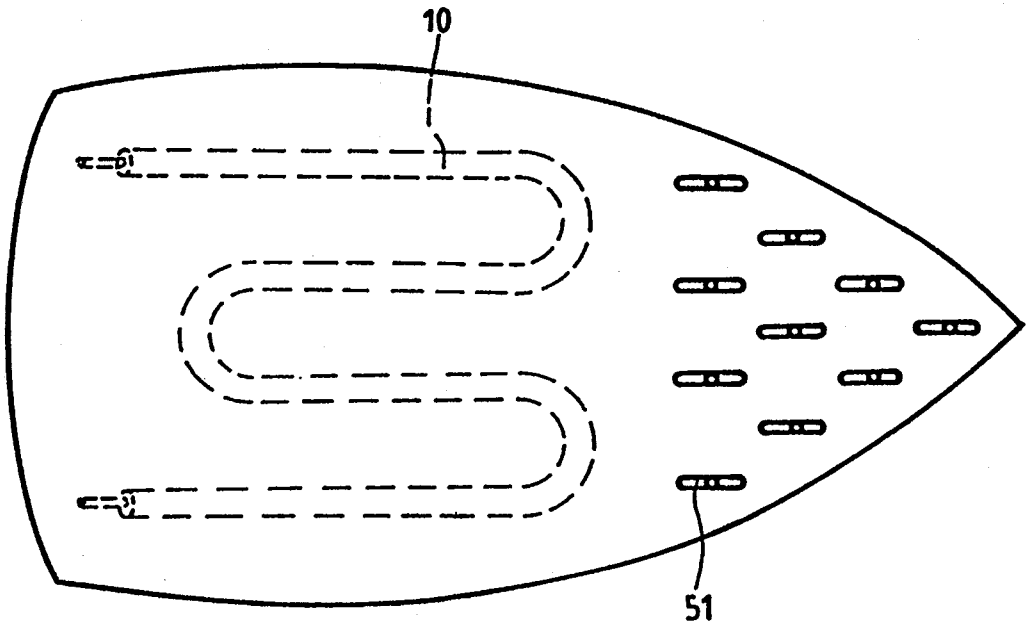
FIG. 5 shows a plan view of a soleplate of the present invention.

Referring to FIG. 1 and 5, an improved steam iron embodied in the present invention is shown to comprise an M-shaped electric heater 10 disposed in the interior of the main body of the steam iron. The electric heater 10 is connected with a power supply cord 11. The water needed for ironing is kept in a water reservoir 12, which is in communication with an electromagnetic valve 17 by means of a water tube 13 provided with a spherical flow control valve 14 for regulating the quantity of water flowing to the electromagnetic valve 17. The steam iron of the present invention comprises a handle 15 provided at the front end thereof with an electromagnetic valve on-off button 16 for regulation the amount of water entering the vaporization device. The vaporization chamber 20, the pressure accumulation chamber 30, the steam emitting chamber 40, and the soleplate 50 are made integrally by casting. The electric heater 10 is disposed between the vaporization chamber 20 and the soleplate 50 during the casting process. The vaporization chamber 20 is heated by the electric heater 10. As the electromagnetic valve on-off button 16 is turned on, the water enters the vaporization chamber 20 through the electromagnetic valve 17. The water is vaporized in the vaporization chamber 20. The steam is sent to the pressure accumulation chamber 30 via an admission port 31. The pressure accumulating container 30 is also heated by the electric heater 10 and has the same high temperature as the vaporization chamber 20. As a result, the steam in the pressure accumulation chamber 30 is reheated. In addition the pressure of the reheated steam in the pressure accumulating container 20 is stabilized and rectified before the reheated steam is sent to the steam emitting chamber 40 via a channel 32 disposed at the bottom of the pressure accumulation chamber 30. The steam emitting chamber 40 has a periphery with a rough groove 41 provided with a steam emitting hole 42 capable of emitting the steam onto a wider area of the material or garment being pressed. The vaporization chamber 20, the pressure accumulation chamber 30, the steam emitting chamber 40 and the soleplate 50 are made integrally. As a result, the steam is not susceptible to condensation in the process. The soleplate 50 is provided with a slot 51 for atomizing further the same emitted through the steam emitting hole 42. The soleplate 50 is heated directly by the electric heater 10. Now referring to FIG. 3, the vaporization chamber 20 is provided with a detachable cover 60 having a water duct 61 coupled with the electromagnetic valve 17. The bottom of the cover 60 is fastened securely to the vaporization chamber 20 by means of a high-pressure washer 62 and a plurality of bolts 63. The steam emitting chamber 40 is also provided with a cover 70, which is fastened to the steam emitting chamber 40 by means of a high-pressure washer 71 and a plurality of bolts 64. As a result, both vaporization chamber 20 and the steam emitting chamber 40 of the present invention can be easily cleaned and washed so as to prolong the service life span of the steam iron of the present invention. The main body of the steam iron of the present invention is shielded by a housing 80 provided at the rear end thereof with a temperature control device 81 furnished with a circuit breaker which automatically interrupts the flow of the electric current at the time when the heating becomes excessive. In addition the steam iron of the present invention is provided with an insulation plate 82 located between the handle 15 and the housing 80 for the prevention of an accidental skin-burning.

The advantages inherent in the present invention are readily apparent and are described further hereinafter.

The vaporization device, the electric heater and the soleplate of the present invention are made integrally so as to maximize the effect of heat conduction. As a result, the steam generated by the vaporization device is always kept in a high-temperature environment inside the steam iron of the present invention. In other words, the steam is not susceptible to condensation.

The effect of the vaporization is reinforced by the pressure accumulation chamber of the present invention. In other words, the steam is reheated in the pressure accumulation chamber in which the pressure of the steam is stabilized and rectified. the hot steam of the steam iron of the present invention is therefore emitted uniformly and continuously to bring about an excellent ironing result.

The vaporization chamber and the steam emitting chamber of the steam iron of the present invention are provided respectively with a detachable cover. Therefore, the clogged steam emitting hole can be easily cleaned to remove the impurities clogging the steam emitting hole. The service life span of the steam iron of the present invention is therefore prolonged.

The steam emitting chamber of the steam iron of the present invention has a rough periphery in which more steam emitting holes can be disposed so as to facilitate the steam to be emitted onto a greater area of the material or garment being pressed.

The steam iron of the present invention is provided with the safety features, such as an insulation plate disposed between the handle and the housing and a circuit breaker disposed in the heating control device. Therefore, the steam iron of the present invention is absolutely safe to use.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. A steam iron comprising:

a temperature control device;

an electromagnetic valve;

a circuit breaker;

an M-shaped electric heater;

a handle having a front end with an on-off button provided at said front end of said handle for turning said electromagnetic valve on and off;

a water reservoir connected with the steam iron through a water tube provided with a flow control valve;

a vaporization chamber provided with a detachable cover fastened thereto by a high-pressure washer and a plurality of screws;

a pressure accumulating chamber disposed in said vaporization chamber and provided with a steam inlet and a steam outlet, said steam inlet being provided at an upper portion of said pressure accumulating chamber;

a steam emitting chamber provided with a detachable cover fastened thereto by a high-pressure washer and a plurality of screws, said steam emitting chamber being in communication with said steam outlet of said pressure accumulating chamber through a duct, said steam emitting chamber having a plurality of steam emitting holes; and a soleplate provided with a steam outlet and a slot adjacent to said steam outlet;

wherein said vaporization chamber, said steam emitting chamber and said soleplate are made integrally; wherein said M-shaped electric heater is disposed between said vaporization chamber and said soleplate; and wherein said pressure accumulating container is disposed in said vaporization chamber and is in direct contact with said M-shaped electric heater so as to receive heat therefrom for stabilizing and rectifying a pressure of said steam before said steam is sent to said steam emitting chamber from which said steam is emitted via said steam emitting via said steam emitting holes onto an object being pressed.

2. The improved steam iron of claim 1 wherein said detachable cover is detachable for removing impurities clogging said steam emitting holes.

3. The improved steam iron of claim 1 wherein said flow control valve is a ball valve.

* * * * *